US011938585B1

(12) United States Patent
McConville

(10) Patent No.: US 11,938,585 B1
(45) Date of Patent: Mar. 26, 2024

(54) SANDER APPARATUS AND METHOD

(71) Applicant: Stringtech Workstations Inc., Harrow (CA)

(72) Inventor: Michael E. McConville, Stratford (CA)

(73) Assignee: Stringtech Workstations Inc., Harrow (CA)

( * ) Notice: Subject to any disclaimer, the term of this patent is extended or adjusted under 35 U.S.C. 154(b) by 160 days.

(21) Appl. No.: 17/513,089

(22) Filed: Oct. 28, 2021

Related U.S. Application Data

(60) Provisional application No. 63/106,963, filed on Oct. 29, 2020.

(51) Int. Cl.

| | |
|---|---|
| ***B24B 45/00*** | (2006.01) |
| ***B24B 27/00*** | (2006.01) |
| ***B24B 27/02*** | (2006.01) |
| ***B24B 41/00*** | (2006.01) |
| ***B24B 41/02*** | (2006.01) |
| ***B24B 41/04*** | (2006.01) |
| ***B24B 41/047*** | (2006.01) |
| ***B24D 9/04*** | (2006.01) |

(Continued)

(52) U.S. Cl.
CPC ..... *B24B 41/04* (2013.01); *B24B 27/0015* (2013.01); *B24B 41/002* (2013.01); *B24B 41/02* (2013.01); *B24B 41/047* (2013.01); *B24B 45/006* (2013.01); *B24D 9/04* (2013.01); *B24D 9/08* (2013.01); *B24B 11/10* (2013.01); *B24B 19/26* (2013.01); *B24B 27/02* (2013.01)

(58) Field of Classification Search
CPC ..... B24B 41/002; B24B 41/02; B24B 41/04; B24B 41/047; B24B 11/10; B24B 19/26; B24B 27/0015; B24B 27/02; B24B 45/006; B24B 45/00; B24D 9/04; B24D 9/08; B24D 5/16; B24D 7/17
USPC ..... 451/59, 259, 360, 361, 363, 178, 342
See application file for complete search history.

(56) References Cited

U.S. PATENT DOCUMENTS 667,960 A * 2/1901 Taber ..... B24B 27/02 451/259
926,101 A 6/1909 Connet
(Continued)

FOREIGN PATENT DOCUMENTS

CN 207669050 U 7/2018

OTHER PUBLICATIONS

CN 207669050U—Machine-Generated English Language Translation.

*Primary Examiner* — Eileen P Morgan
(74) *Attorney, Agent, or Firm* — Gowling WLG (Canada) LLP

(57) ABSTRACT

A sander apparatus for use with a drill press having a chuck defining a drill chuck axis. The sander apparatus includes a base assembly and a sander assembly supported by the base assembly, the base assembly locating the sander assembly in a predetermined location relative to the drill press chuck, in which a central pin axis of the sander assembly is aligned with the drill chuck axis. When a portion of an upper shaft of the sander assembly is secured in the chuck, rotation of the chuck about the drill chuck axis causes corresponding rotation of a body element of the sander assembly about the central pin axis. The base assembly supports the sander assembly in the predetermined location thereof as a workpiece is engaged with one or more abrasive elements on the body element while the body element rotates about the central pin axis.

13 Claims, 9 Drawing Sheets

(51) Int. Cl.

| | |
|---|---|
| ***B24D 9/08*** | (2006.01) |
| *B24B 11/10* | (2006.01) |
| *B24B 19/26* | (2006.01) |

(56) References Cited

U.S. PATENT DOCUMENTS 992,702 A * 5/1911 Berg ..... B24B 27/02 451/361
1,432,027 A * 10/1922 Leonard ..... B25H 1/0042 408/100
2,477,484 A 7/1949 Hunt
2,519,542 A * 8/1950 Carey ..... B24B 41/002 451/155
2,570,107 A 10/1951 Gallagher
2,645,886 A 7/1953 Peterson
2,753,668 A 7/1956 Strnad
2,877,608 A 3/1959 Clitty
2,930,164 A * 3/1960 Metoff ..... B24B 27/0046 451/155
2,933,864 A 4/1960 Marshall
3,703,055 A * 11/1972 Niquet ..... B24B 3/247 D8/71
3,942,289 A * 3/1976 Greer ..... B24B 23/08 451/430
4,030,250 A 6/1977 Walker
4,050,194 A 9/1977 Rice
4,156,326 A * 5/1979 Frost, Jr. ..... B24B 23/08 451/430
4,830,069 A 5/1989 Milyard
5,394,652 A * 3/1995 Casillas ..... B24B 9/18 451/241
5,402,605 A 4/1995 Paules
5,525,099 A * 6/1996 Baird ..... B24B 41/002 451/157
5,643,406 A * 7/1997 Shimomura ..... B24B 57/02 438/693
5,769,575 A 6/1998 Stofflet et al.
5,842,820 A * 12/1998 Lee ..... B23B 51/04 408/206
6,213,851 B1 4/2001 Garcia et al.
6,494,649 B2 12/2002 Queipo
7,004,828 B1 * 2/2006 Picou ..... B24B 7/12 451/361
10,569,387 B2 * 2/2020 Philipps ..... B24B 13/012
2004/0058628 A1 * 3/2004 Armstrong ..... B27F 1/04 451/237
2004/0126197 A1 * 7/2004 Allemann ..... B27G 13/002 409/130
2013/0122788 A1 * 5/2013 Chang ..... B24B 37/013 451/340

* cited by examiner

SANDER APPARATUS AND METHOD

CROSS-REFERENCE TO RELATED APPLICATION

This application claims the benefit of U.S. Provisional Patent Application No. 63/106,963, filed on Oct. 29, 2020, the entirety of which is hereby incorporated herein by reference.

FIELD OF THE INVENTION

The present invention is a sander apparatus to be used with a drill press, for abrasion of a workpiece.

BACKGROUND OF THE INVENTION

As is well known in the art, shaping a workpiece to fit precisely with another object may be difficult, and time-consuming. For example, a craftsman may use a vise or clamp to hold the workpiece while the craftsman manually moves sandpaper or another abrasive tool rapidly against the workpiece, to remove material as required. The workpiece may be formed in this way, e.g., into a guitar nut, or a bridge, or another element of a guitar that must be formed to fit precisely in place.

In the prior art, the craftsman may estimate the amount of material that is to be removed while he is sanding the workpiece, but also may remove the workpiece from the vise occasionally, e.g., to determine whether the workpiece has been sufficiently sanded to fit. The workpiece may be repeatedly removed from the vise, and then subsequently returned to it.

Accordingly, manually sanding the workpiece to form it into a preselected shape having a predetermined precise curvature is usually a laborious, time-consuming process. This is particularly true where the predetermined curvature has a relatively large radius, because the desired curvature may be difficult to estimate in practice.

In the prior art, the craftsman typically chooses to sand the element manually due to the absence of suitable motorized alternatives. However, depending on the size of the element and the amount of material to be removed, manual sanding may in practice be difficult.

A wide variety of motor-driven sanding devices are known, however, they typically are formed to present a flat abrasive surface, positioned horizontally or vertically, which is rotated to sand or grind down the element to be sanded. In some motor-drive sanding devices, a cylindrical abrasive surface is provided that rotates about a vertical axis.

Accordingly, where the element is to be formed to provide a curvature with a relatively large radius, the known sanding devices do not provide a suitable abrasive surface. As a result, it is difficult for the craftsman to achieve the degree of precision required in the predetermined curvature using the prior art devices.

SUMMARY OF THE INVENTION

For the foregoing reasons, there is a need for a sander apparatus and method that overcomes or mitigates one or more of the disadvantages or defects of the prior art.

In its broad aspect, the invention provides a sander apparatus including a base assembly, with a base body and one or more load bearings, and a sander assembly, with a body element and a pin subassembly having a lower shaft receivable in an aperture in the base body.

The body element has a top surface, an opposed bottom surface, and an edge surface that is transverse to the top and bottom surfaces. The pin subassembly is centrally positioned in the body element and secured to the body element. The pin subassembly is defined by a central pin axis thereof, and includes an upper shaft extending from the top surface.

The sander assembly includes a primary sandpaper element that is secured to the top surface of the body element. The sander assembly may also include a secondary sandpaper element that is secured to the edge surface of the body element.

The base assembly is formed to locate the sander assembly so that the upper shaft is coaxial with a chuck of a drill press, and the upper shaft is securable in the chuck. When the upper shaft is secured in the chuck, rotation of the chuck about its drill chuck axis causes corresponding rotation of the body element about the central pin axis. The bottom surface engages the one or more load bearings, to support the body element as the body element rotates about the central pin axis.

BRIEF DESCRIPTION OF THE DRAWINGS

The invention will be better understood with reference to the attached drawings, in which.

DETAILED DESCRIPTION

Figure 1A:
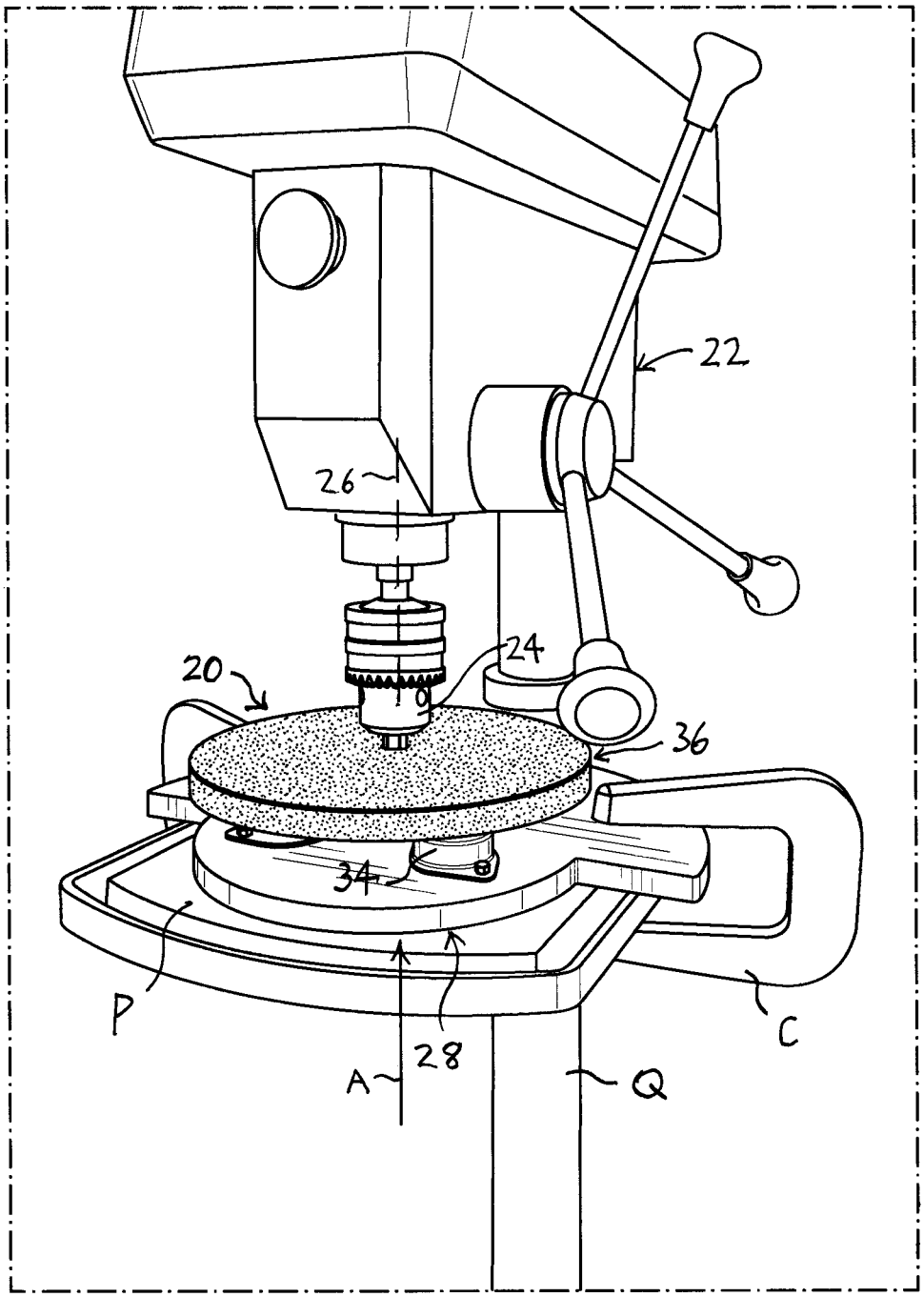
FIG. 1A is an isometric view of an embodiment of a system of the invention including an embodiment of a sander apparatus of the invention, mounted to a drill press.

In the attached drawings, like reference numerals designate corresponding elements throughout. Reference is first made to FIGS. 1A-6B to describe an embodiment of a sander apparatus in accordance with the invention indicated generally by the numeral 20.

Figure 1B:
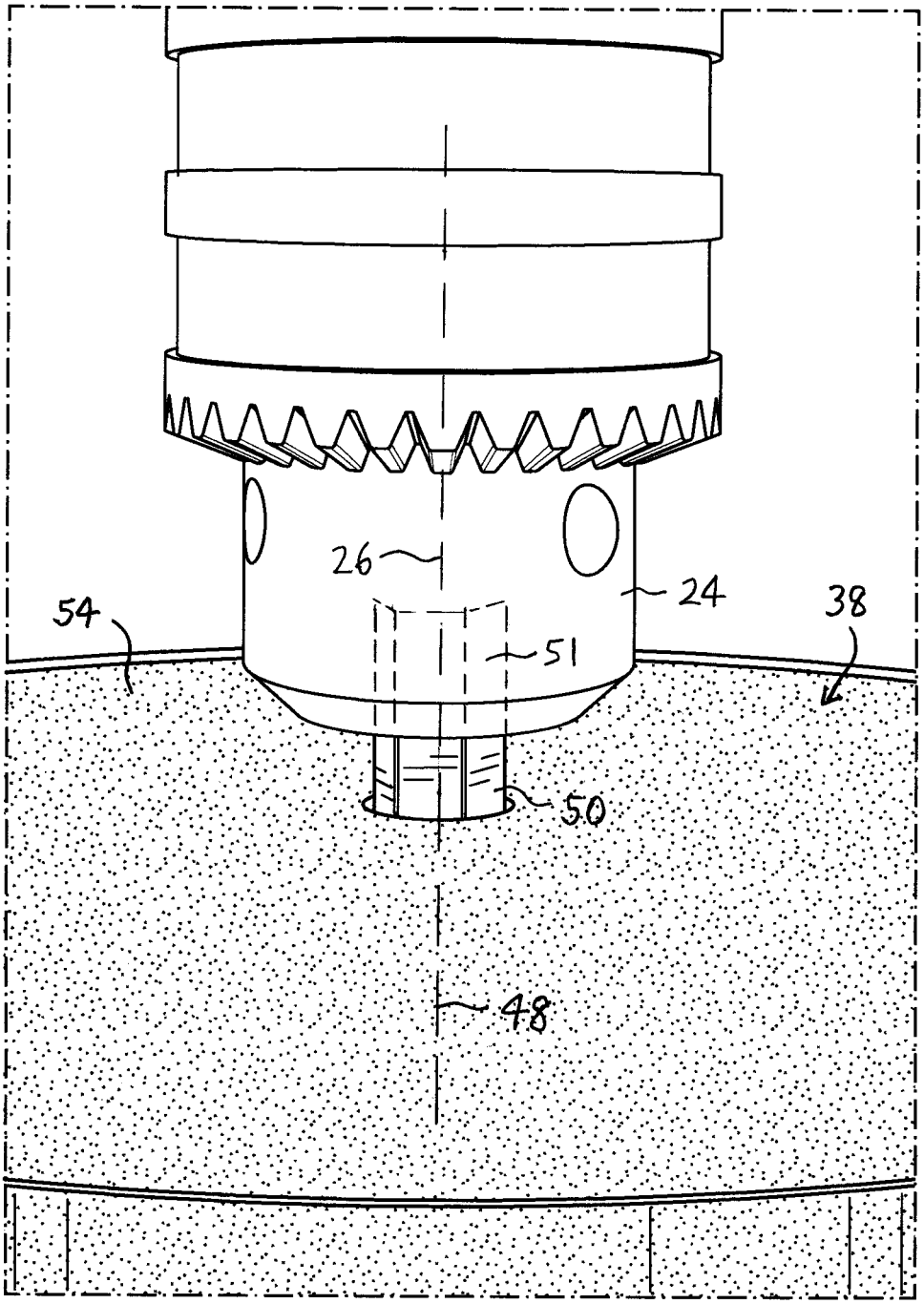
FIG. 1B is an isometric view of an upper shaft of the sander apparatus of FIG. 1A secured in a chuck of the drill press, drawn at a larger scale.
Figure 5:
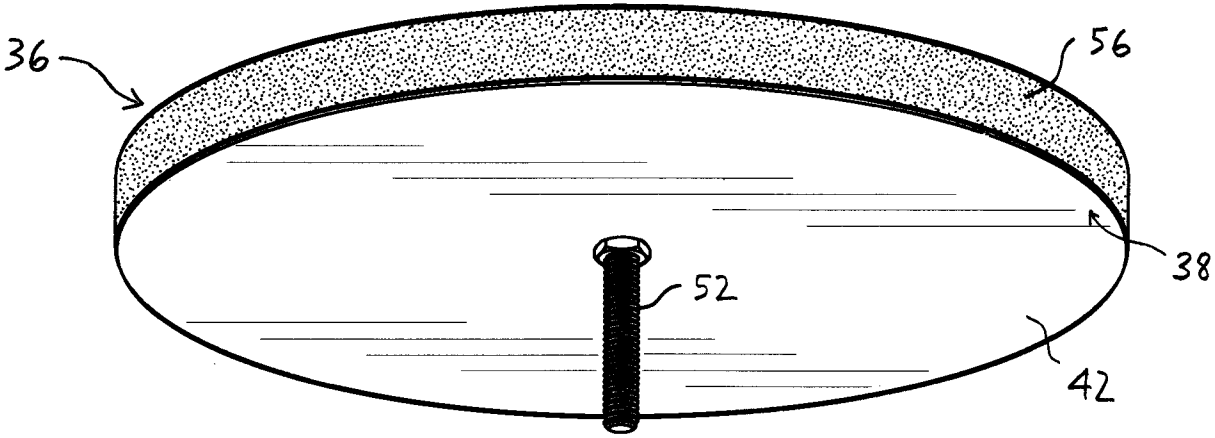
FIG. 5 is an isometric bottom view of a sander assembly of the sander apparatus of FIGS. 2A-3.
Figure 6A:
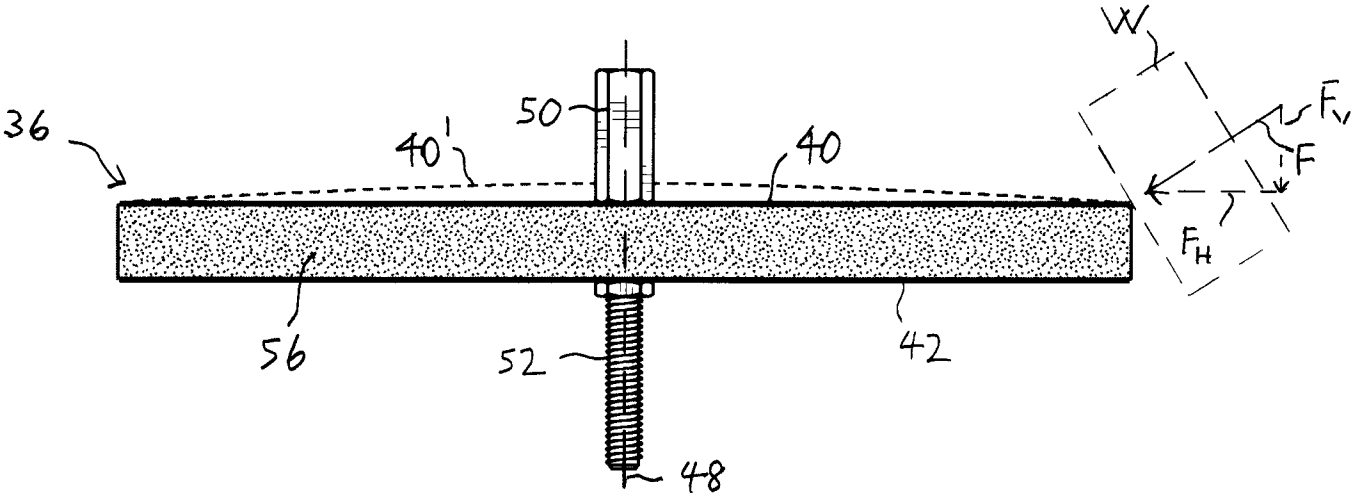
FIG. 6A is a side view of the sander assembly of FIG. 5.

As will be described, in one embodiment, the sander apparatus 20 is for use with a drill press 22 having a chuck 24 defining a drill chuck axis 26 thereof for abrasion of a workpiece "W" (FIGS. 1B, 6A). Preferably, the sander apparatus 20 includes a base assembly 28 having a base body 30 with an aperture 32 therein (FIG. 4), and one or more load bearings 34 mounted on the base body 30. It is also preferred that the sander apparatus 20 includes a sander assembly 36 (FIGS. 5, 6A).

As will also be described, it is preferred that the sander assembly 36 includes a body element 38 and one or more abrasive elements (e.g., sandpaper), to provide suitably abrasive surfaces, secured to the body element 38. It will be understood that only one of the abrasive elements is included in FIG. 3, for clarity of illustration.

In an example illustrated in FIG. 6A, the workpiece "W" is pushed in the direction indicated by arrow "F" against the sander assembly 36 while the body element 38 is rotating. As will be described, the workpiece "W" is engaged with one or both of the abrasive elements on the rotating body element 38 to shape the workpiece "W" into a predetermined shape.

Figure 3:
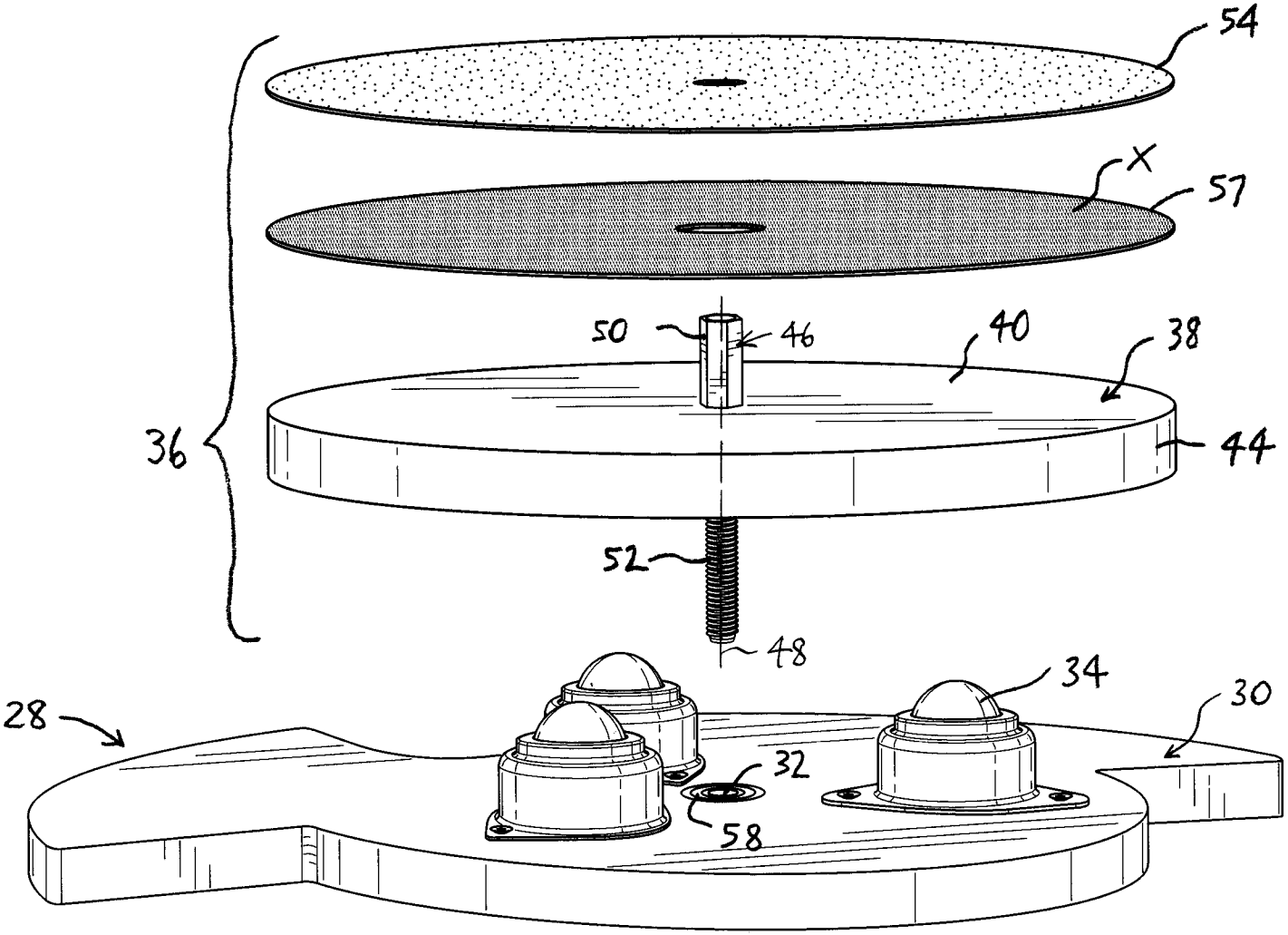
FIG. 3 is an isometric exploded view of the sander apparatus of FIG. 2A, from which sandpaper elements are omitted.

In one embodiment, the body element 38 preferably defines a disc having a top surface 40 (FIG. 3), an opposed bottom surface 42 (FIGS. 5, 6A), and an edge surface 44 that is located transverse to the top and bottom surfaces 40, 42 (FIG. 3). It is also preferred that the sander assembly 36 includes a pin subassembly 46 centrally positioned in the body element 38 (FIG. 3). The pin subassembly 46 preferably is secured to the body element 38, by any suitable means.

As can be seen in FIG. 3, the pin subassembly 46 is at least partially defined by a central pin axis 48 thereof. The pin subassembly 46 preferably includes an upper shaft 50 securable in the chuck 24, to align the central pin axis 48 with the chuck axis 26. Preferably, the upper shaft 50 extends from the top surface 40. As can also be seen in FIG. 3, the pin subassembly 46 preferably includes a lower shaft 52 partially receivable in the aperture 32, to allow rotation of the lower shaft 52 about the central pin axis 48.

Because the pin subassembly 46 (which includes the upper and lower shafts 50, 52) is secured to the body element 38, rotation of the pin subassembly 46 about the central pin axis 48 causes corresponding rotation of the body element 38 about the central pin axis 48. When the upper shaft 50 is secured in the drill press chuck 24, rotation of the drill press chuck 24 about the drill chuck axis 26 causes corresponding rotation of the body element 38 about the central pin axis 48. Those skilled in the art would appreciate that the drill press chuck 24 is rotated about its axis by a motor (not shown) of the drill press.

It will be understood that, in order for the sander apparatus 20 to provide a suitably abrasive rotating surface, one or both of the top surface 40 and the edge surface 44 of the body element 38 preferably are covered with a suitably abrasive finish or material. In one embodiment, the sander assembly 36 preferably includes one or more abrasive elements. The abrasive elements may be any suitable abrasive elements. In the illustrated example, the sander assembly 36 preferably includes a primary sandpaper element 54, secured (directly or indirectly) to the top surface 40, and a secondary sandpaper element 56, secured (directly or indirectly) to the edge surface 44.

The primary and secondary sandpaper elements 54, 56 preferably are secured to the top surface 40 and the edge surface 44 respectively, directly or indirectly. It will be understood that the sandpaper elements 54, 56 may be secured to the top surface 40 and the edge surface 44 respectively, directly or indirectly, by any suitable means.

Those skilled in the art would appreciate that it is also preferred that the sandpaper elements 54, 56 are readily removable, so that they may conveniently be replaced when they are worn out, or when a user (not shown) wishes to use sandpaper elements having different characteristics (e.g., different coarseness).

In one embodiment, the sander assembly 36 preferably includes a layer 57 with a lower side (not shown) that is secured to the top surface 40. The layer 57 preferably also includes an upper side "X" (FIG. 3) that is adapted for removably securing sandpaper elements 54 to the upper side "X". As an example, the upper side "X" may include small hooks that may engage an inner side (not shown) of the sandpaper element 54 that is adapted to be engaged by, and held in place by, such hooks, in a "hook and loop" fastening system. Because hook and loop fastening systems are known in the art, further description thereof is unnecessary. Those skilled in the art would appreciate that this arrangement advantageously permits rapid and convenient replacement of the sandpaper element 54 with another sandpaper element, e.g., a new sandpaper element, or one that is more or less coarse, as the case may be.

Various means for removably securing the sandpaper elements 54, 56 to the body element 38 may be used. For example, in one embodiment, the layer 57 that is part of the hook and loop fastening system may be secured to the top surface 40, as noted above, and two-sided adhesive tape (not shown) may be used to secure the secondary sandpaper element 56 to the edge surface 44. Alternatively, another layer (not shown) of the hook portion of the hook and loop fastening system may be secured to the edge surface 44, to indirectly secure the sandpaper element 56 to the edge surface 44.

Preferably, the base assembly 28 is formed to locate the sander assembly 36 in a predetermined location relative to the chuck 24, when the upper shaft 50 is secured in the chuck 24. The sander assembly 36 is shown in the predetermined location relative to the chuck 24 in FIGS. 1A and 1B. As can be seen in FIGS. 1A and 1B, when the sander assembly 36 is located in the predetermined location thereof, the upper shaft 50 is coaxial with the chuck 24, and securable in the chuck 24. As noted above, when the upper shaft 50 is secured in the chuck 24, rotation of the chuck 24 about the drill chuck axis 26 causes corresponding rotation of the body element 38 about the central pin axis 48.

When the sander assembly 36 is in the predetermined location thereof, the load bearings 34 engage the bottom surface 42 and the lower shaft 52 is partially located in the aperture 32, to support the sander assembly 36 in the predetermined location as the workpiece "W" is engaged with the abrasive element 54, 56 while the body element 38 rotates about the central pin axis 48.

As can be seen in FIG. 1A, the drill press 22 preferably includes a work table or platform "P" mounted to a substantially vertical pillar "Q". Those skilled in the art would appreciate that, in a conventional drill press, the platform "P" may be moved vertically on the pillar "Q" to locate the platform "P" in a selected location relative to the chuck 24, e.g., to enable a bit (not shown) secured in the drill press chuck to drill into an object (not shown).

Accordingly, in order to locate the sander assembly 36 in the predetermined location thereof, the platform "P" is located vertically apart from the chuck 24 so that the sander apparatus 20 may be located on the platform "P", between the chuck 24 and the platform "P". The sander assembly 20 preferably is positioned on the platform "P" to approximately align the central pin axis 48 with the drill chuck axis. At this point, the sander assembly 20 preferably is not secured to the platform "P". The platform "P" is then moved up the pillar "Q" to a point at which the upper shaft 50 is proximal (and slightly below) the drill press check 24, to enable the user to approximately align the central pin axis 48 with the drill chuck axis 26. Once these axes are approximately vertically aligned, the platform "P" is moved upwardly relative to the pillar "Q" and the chuck 24, to position a portion 51 of the upper shaft 50 inside the drill chuck 24 (FIG. 1B). The upward movement of the platform "P" is indicated by arrow "A" in FIG. 1A.

In one embodiment, the upper shaft 50 preferably has a hexagonal shape in cross-section, so that internal jaw elements (not shown) of the drill press chuck 24 may positively engage external surfaces of the portion 51 of the upper shaft 50, when the chuck 24 is tightened onto the part of the upper shaft 50 that is received in the chuck 24. Because the manner in which the upper shaft 50 is secured in the drill press chuck 24 is conventional, further description thereof is unnecessary. The chuck 24 is cinched or tightened onto the portion 51 of the upper shaft 50 that is received therein, to secure the chuck 24 to the upper shaft 50, to align the central pin axis 48 with the drill chuck axis 26. Those skilled in the art would appreciate that cinching the chuck 24 onto the portion 51 of the upper shaft 50 may effect a fine adjustment to align the central pin axis 48 precisely with the drill chuck axis 26.

Once the drill press chuck 24 has been cinched onto the portion 51 of the upper shaft 50 positioned inside the drill press chuck 24, the sander assembly 36 is located in the predetermined location thereof relative to the drill press chuck 24 (FIG. 1B). At this point, the base body 30 preferably is secured to the platform "P". This may be done using any suitable means. In one embodiment, for example, the base body 30 preferably is secured to the work table or platform "P" by clamps "C" (FIG. 1A).

As noted above, the upper shaft 50 is part of the pin subassembly 46, which is secured to the body element 38 of the sander assembly 36. Rotation of the upper shaft 50 about the central pin axis 48 therefore also necessarily results in corresponding rotation of the body element 38 about the central pin axis 48. As a result, when the drill press 22 is energized and the chuck 24 is caused thereby to rotate about the drill chuck axis 26, causing the portion 51 in the chuck 24 to rotate, the entire upper shaft 50 is also rotated about the central pin axis 48, and the body element 38 rotates correspondingly about the central pin axis 48.

Figure 2A:
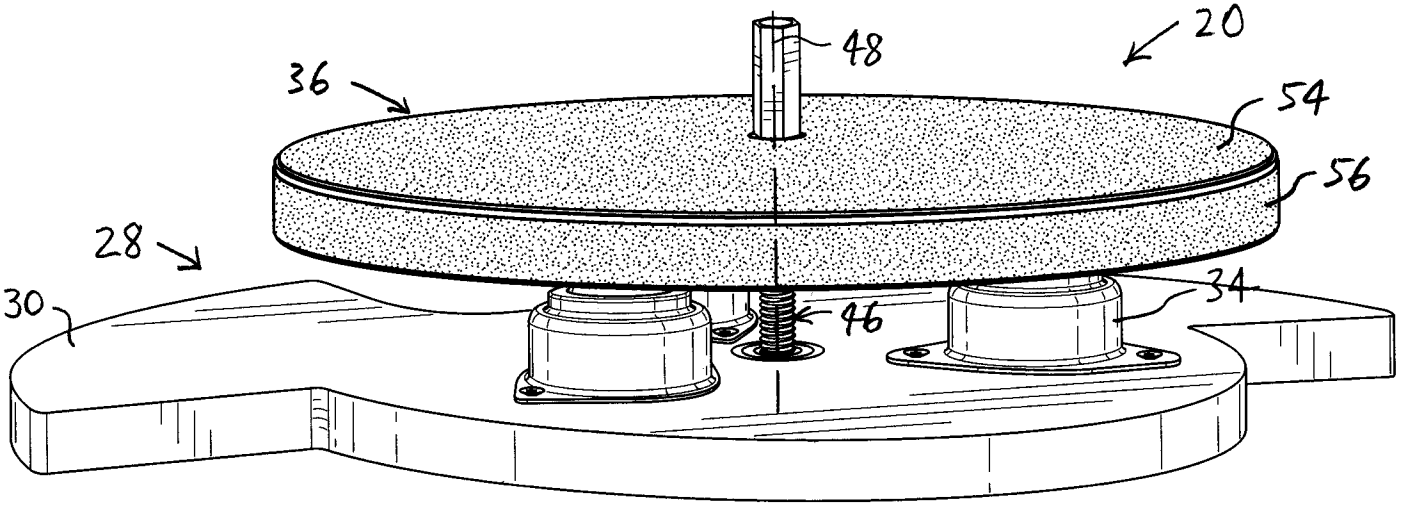
FIG. 2A is an isometric view of the sander apparatus of FIGS. 1A and 1B, drawn at a smaller scale.
Figure 2B:
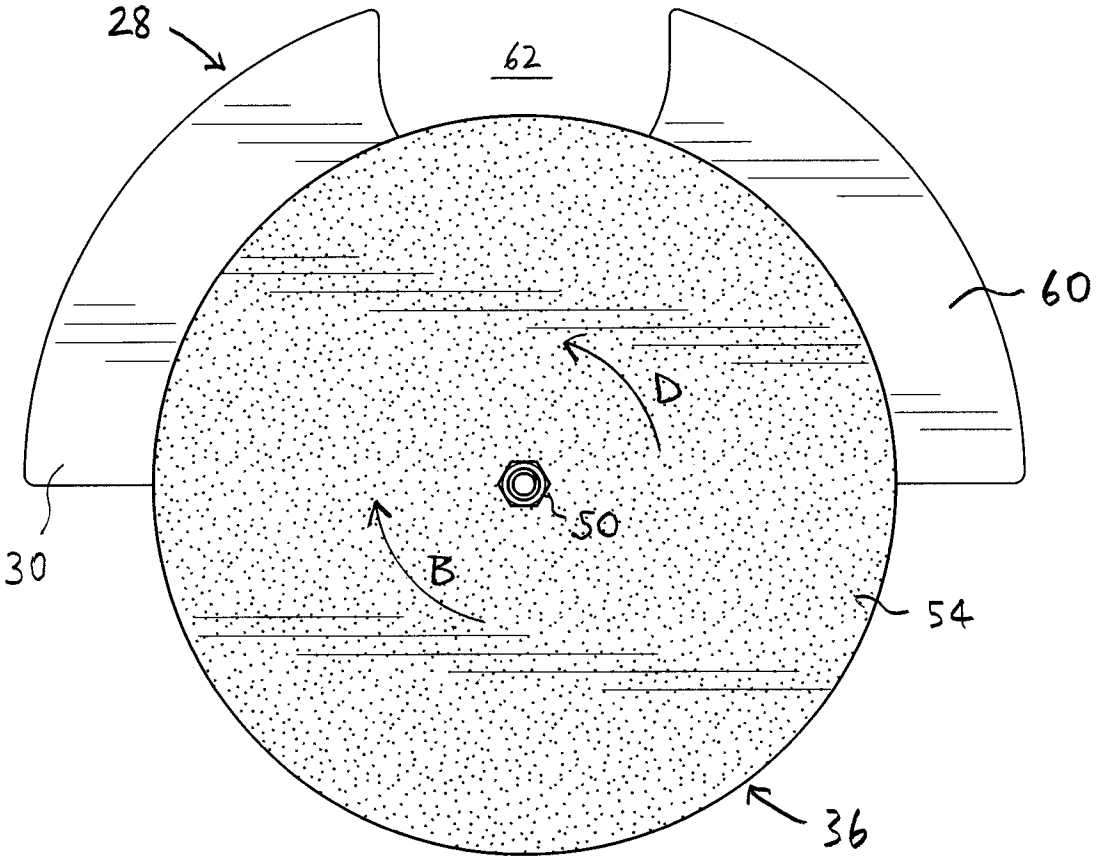
FIG. 2B is a top view of the sander apparatus of FIG. 2A.

The possible directions of rotation of the body element 38 about the central pin axis 48 are indicated in FIG. 2B by arrows "B" and "D" respectively. Those skilled in the art would appreciate that the direction of rotation of the body element 38 may be clockwise or counter-clockwise, depending on the drill press 22. The speed of rotation of the chuck 24 about its axis 26 may be any suitable speed of rotation, for example, approximately 220 rpm. Those skilled in the art would also appreciate that the drill press 22 may be controlled in any suitable manner. For example, in one embodiment, the user may control energization of the drill press 22 via a foot-operated intermittent switch (not shown).

In FIG. 6A, only the sander assembly 36 is shown, for clarity of illustration. The drill press 22 and the base assembly 28 are omitted from FIG. 6A. When the drill press 22 is energized, thereby causing the body element 38 to rotate about the central pin axis 48, the user may engage the workpiece "W" against the abrasive element(s) that are mounted on the body element 38 as needed in order to shape the workpiece "W" into a predetermined shape. The user may position the workpiece "W" as needed, for engagement thereof with the abrasive elements at any suitable location(s) on the abrasive elements, in order to shape the workpiece as required. In the example illustrated in FIG. 6A, it can be seen that the workpiece "W" is pushed in the direction indicated by arrow "F" against the abrasive elements 54, 56 of the sander assembly 36.

In the example illustrated, the force "F" pushing the workpiece "W" against the sander assembly 36 may be resolved into a vertically directed force "$F_v$", which is directed vertically downwardly (i.e., parallel to the central pin axis 48), and a horizontally directed force "$F_H$", which is directed horizontally (i.e., orthogonal to the central pin axis 48). As will be described, the load bearings 34 (not shown in FIG. 6A), engaging the bottom surface 42 of the body element 38, resist the downwardly-directed force schematically represented in FIG. 6A by "$F_v$". The load bearings 34 are supported by the base body 30, which is supported in turn by the work table or platform "P". Also, the upper and lower shafts 50, 52 and the central bearing 58 (not shown in FIG. 6A) resist the horizontally-directed force schematically represented in FIG. 6A by "$F_H$". The force "F" is directed partially downwardly, and as a result, minimal horizontal forces are directed against the upper shaft 50. Because a part 53 of the lower shaft 52 is located in the central aperture 32 (FIG. 6B), that part 53 is supported by the base body 30, to resist the horizontal force "$F_H$". It will be understood that the vertical and horizontal forces are ultimately primarily resisted by the worktable "P".

The sander apparatus 20 is configured to support the sander assembly 36 against the vertically directed and horizontally directed forces to which the sander assembly 36 is subjected, when the workpiece "W" is engaged with the abrasive elements 54, 56.

Figure 6B:
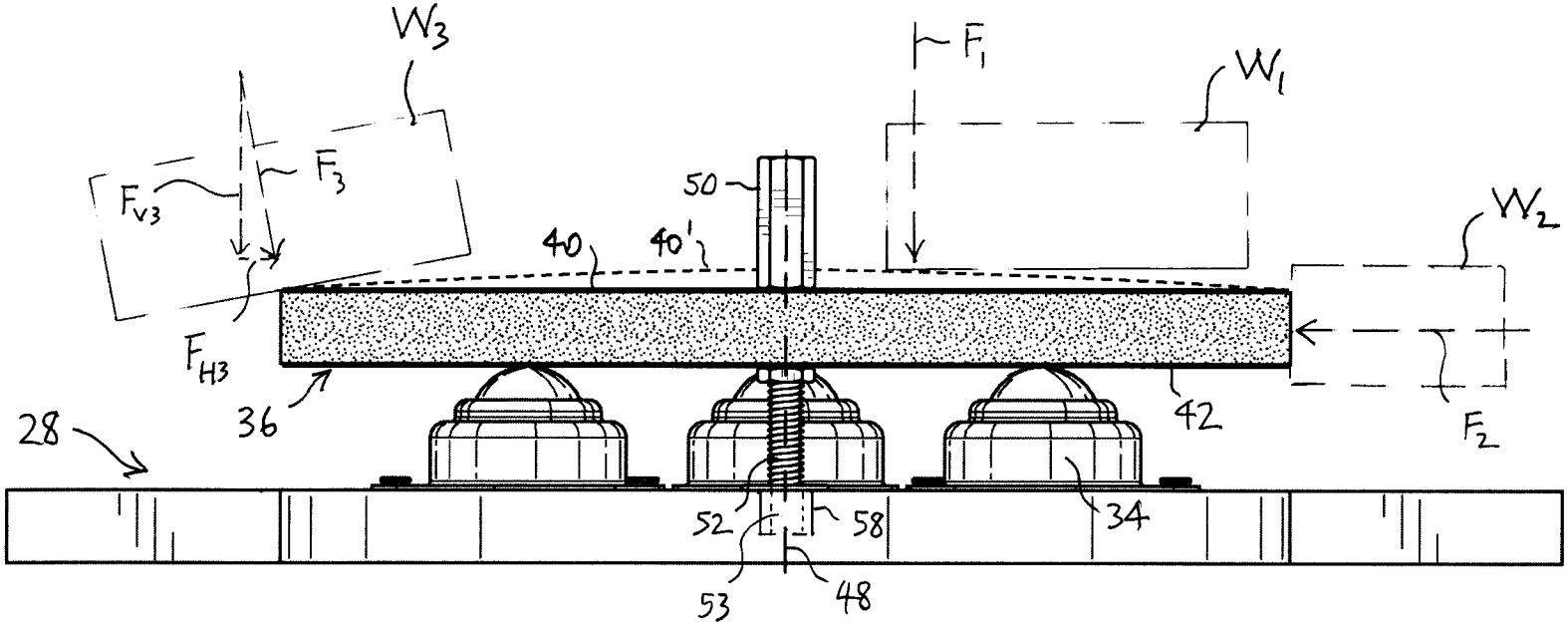
FIG. 6B is a side view of the sander apparatus of FIGS. 1A-6A.

Additional examples are illustrated in FIG. 6B, in which the sander apparatus 20 is illustrated, but the drill press 22 is omitted for clarity of illustration. In FIG. 6B, workpieces identified respectively as "$W_1$", "$W_2$", and "$W_3$" are shown engaged with one or more of the abrasive elements 54, 56, at different locations on the abrasive elements respectively. It will be understood that the body element 38 is rotating about the central pin axis 48 while each of the workpieces "$W_1$", "$W_2$", and "$W_3$" is respectively engaged with the abrasive element(s). The workpiece "$W_1$", for example, is shown engaged with the sandpaper element 54 on a curved top side 40', pressed vertically downwardly, as indicated by arrow "$F_1$".

As can be seen in FIG. 6B, the user may engage the workpiece "$W_1$" against the primary sandpaper element 54 on the top side 40', while the body element 38 is rotating about the central pin axis 48. Similarly, the user may engage the workpiece "$W_2$" against the secondary sandpaper element 56 on the edge surface 44, while the body element 38 is rotating about the central pin axis 48. The workpiece "$W_2$" is pushed against the secondary abrasive element 56 in a generally horizontal direction, as schematically represented by arrow "$F_2$".

As another example, the workpiece "$W_3$" is pushed against the abrasive elements 54, 56 as schematically represented by arrow "$F_3$". The force exerted by the user pushing the workpiece "$W_3$" against the abrasive elements may be resolved into a vertical component (schematically represented by arrow "$F_{V3}$") and a horizontal component (schematically represented by arrow "$F_{H3}$").

It can be seen in FIG. 6B that the vertically directed downward force schematically represented by arrow "$F_1$" is resisted at first instance by the load bearings 34 that engage the bottom surface 42. The load bearings 34 are supported by the base body 30, which is supported in turn by the work table "P".

The horizontally directed force schematically represented by arrow "$F_2$" is resisted at first instance by the upper lower shafts 50, 52 and the central bearing 58. As can be seen in FIG. 6B, a part 53 of the lower shaft 52 is located in the central bearing 58. (It will be understood that the portion 51 of the upper shaft 50 is secured in the drill press chuck 24.) The central bearing 58 is supported by the base body 30, in which it is embedded.

When the workpiece "$W_3$" is urged against the sander assembly 36 in a direction that, as indicated by arrow "$F_3$", is at an acute angle to the vertical, then the force exerted in that direction is resolved into a vertical component and a horizontal component. The force schematically represented by "$F_3$" is resisted (i) at first instance by the load bearings 34, and also (ii) at first instance by the upper and lower shafts 50, 52 and the central bearing 58. The force "$F_3$" is directed partially downwardly onto the top surface, and as a result, minimal horizontal forces are directed against the upper shaft 50. Those skilled in the art would appreciate that the horizontal forces resulting from force "$F_3$" are primarily resisted by the central bearing 58.

From the foregoing, it can be seen that the sander apparatus 20, once mounted to the drill press 22, provides rotating abrasive surfaces (e.g., sandpaper-covered surfaces) that may be used for forming relatively precisely curved surfaces on relatively small workpieces.

It will be understood that the top surface 40 of the body element 38 may have any suitable shape. For instance, the top surface 40 may be planar, i.e., substantially horizontal, when the sander assembly 36 is in the predetermined location thereof. Alternatively, the top surface 40 may be concave or convex. For instance, the top surface 40 preferably is curved to form the convex curved surface 40', which is symmetrical with respect to the central pin axis 48. It is also preferred that the curved surface 40' is defined by a predetermined spherical radius.

For example, and as schematically illustrated in FIG. 6A, the curved surface 40' may be a convex surface. The convex surface may have any suitable spherical radius, however, it is preferred that the radius of the convex surface is relatively large in relation to the diameter of the body element 38. In one embodiment, for instance, the spherical radius may be approximately 24 feet. As an example, the body element 38 may have a diameter of approximately nine inches. It will be understood that the curved surface 40' as illustrated in FIG. 6A is exaggerated, for clarity of illustration.

Those skilled in the art would appreciate that, because body elements 38 may provide surfaces with different curvatures, the user may conveniently utilize these surfaces to form curved surfaces on the workpieces that may have different radii. Those skilled in the art would appreciate that, if preferred, multiple sander assemblies 36 may be used, in sequence, with a base assembly 28 that has been secured to the platform "P" to locate the sander assemblies 36 successively in the predetermined locations thereof, relative to the chuck 24. For instance, the user may have a first sander assembly 36 with a body element 38 with a convex top surface 40' in the predetermined location thereof. If the user requires that a body element 38 having a concave top surface is needed, the first sander assembly 36 may be removed from the base assembly 28. To do this, the chuck 24 is released, and the platform "P" is lowered. The base assembly 28 remains secured to the platform "P", and a sander assembly with a body element having a concave top surface is positioned on the base assembly 28, which has remained on the platform "P". At this point, the platform "P" may be raised, to locate the portion 51 of the upper shaft 50 inside the chuck 24.

The base body 30 may be released, in order to enable slight adjustments in the position of the base assembly 28 to be made when the chuck 24 is tightened onto the portion 51 positioned in the chuck 24. Once the chuck 24 has been tightened, the new sander assembly 36 is in its predetermined location relative to the chuck 24, and the base body 30 may be secured again to the platform "P", e.g., by the clamps "C".

Figure 4:
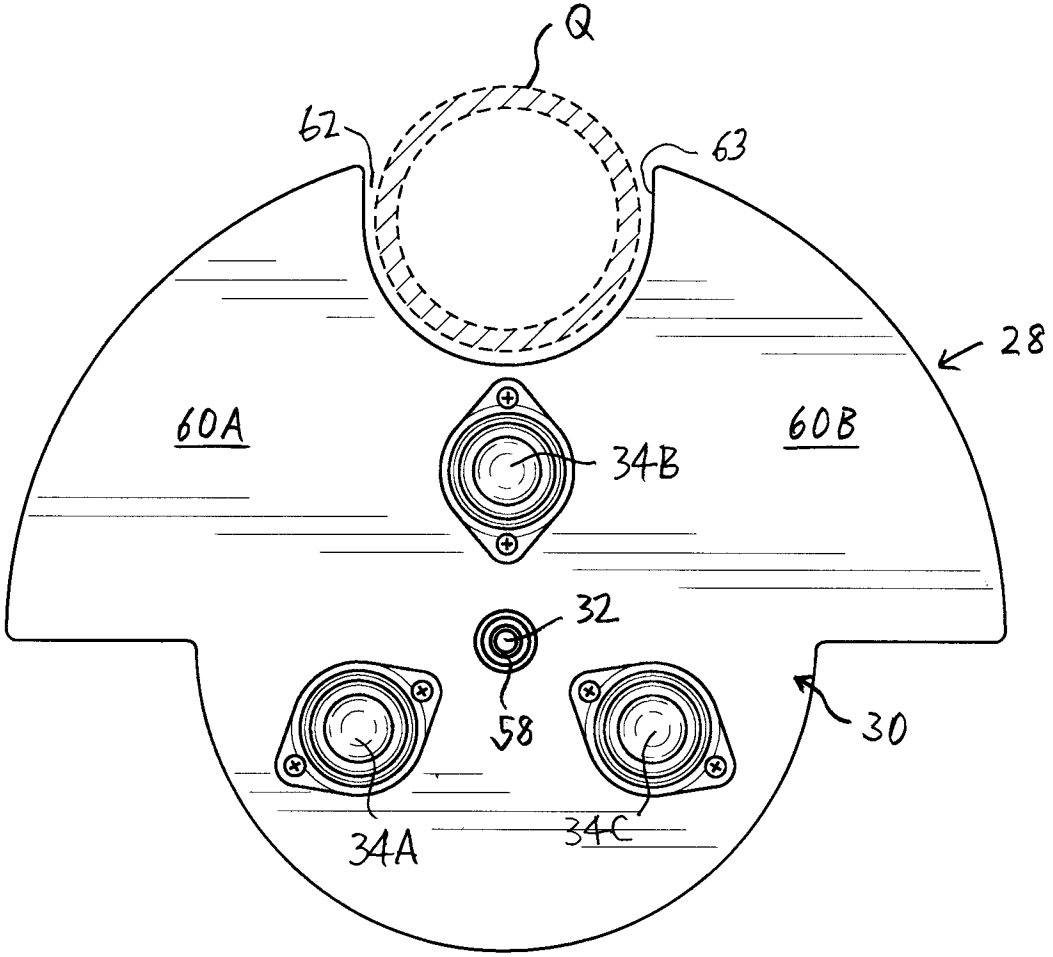
FIG. 4 is a top view of a base assembly of the sander apparatus of FIGS. 2A-3.

As can be seen in FIGS. 3 and 4, it is preferred that the aperture 32, in which the lower shaft 52 is partially located when the sander assembly 36 is in the predetermined location, is defined by the central bearing 58 mounted in the base body 30. As can be seen, e.g., in FIG. 3, the central bearing 58 preferably is recessed into the base body 30. The bearing 58 may be press-fit into the base body 30. Preferably, the lower shaft 52 is formed so that it has a fit in the aperture 32 in the central bearing 58 that permits substantially free rotation of the pin subassembly 46 about the central pin axis 48. It will be understood that the lower shaft 52 preferably fits into the aperture 32 with a relatively close tolerance because of the need for the lower shaft 52 to resist laterally-directed or transverse forces to which the lower shaft 52 may be subjected.

In one embodiment, the upper shaft 50 preferably has a hexagonal cross-section, for cooperation with the chuck 24, when the chuck 24 is engaged with the upper shaft 50. The hexagonal form of the upper shaft 50 can be seen, e.g., in FIGS. 1B, 2A, and 2B. Those skilled in the art would appreciate that, because of the hexagonal form of the upper shaft 50, the chuck 24 may be secured to the upper shaft 50.

It is also preferred that the base body 30 includes one or more extended portions 60, as can also be seen in FIG. 4. It will be understood that, as illustrated in FIG. 1A, the extended portions 60 may be used to secure the base body 60 to the work table or platform "P" of the drill press 22. Preferably, the clamps "C" engage the extended portions 60A, 60B, to secure the base body 30 to the platform "P". In FIG. 4, the extended portions are identified by reference characters 60A and 60B for convenience.

Preferably, and as can be seen in FIG. 4, the base body 30 includes the opening 62 that is formed so that the pillar "Q" of the drill press 22 (FIG. 1A) is partially receivable in the opening 62, to assist in approximately positioning the base body 30 on the platform "P". The opening 62 preferably is defined by an edge portion 63 of the base body 30.

It will be understood that the base assembly 28 may include any suitable number of load bearings, positioned on the base body 30 in any suitable arrangement. As can be seen, e.g., in FIG. 4, it is preferred that the base assembly 28 includes three load bearings, identified for convenience in FIG. 4 by reference characters 34A, 34B, and 34C respectively, positioned on the base body 30 radially equidistant from the central bearing 58.

In use, the platform "P" is first located below the chuck 24, at a height that permits the sander apparatus 20 to be located on the platform "P", between the chuck 24 and the platform "P". At this point, the user may position the base assembly 28 approximately centrally on the platform "P" of the drill press 22. The base body 30 preferably is positioned on the platform "P" to locate the base body 30 so that a horizontal part of the pillar "Q" is partially received in the opening 62. It will be understood that the sander apparatus 20 is positioned on the work table or platform "P" by the user, to approximately align the central pin axis 48 with the drill chuck axis 26.

As described above, the platform "P" preferably is raised to locate the upper shaft 50 proximal to the chuck 24, to enable the user to adjust alignment of the central pin axis 48 with the drill chuck axis 26.

Preferably, the portion of the upper shaft 50 is positioned in the chuck 24, and the chuck 24 is then tightened around such part, with the hexagonal surfaces of the upper shaft 50 being fully and positively engaged by internal surfaces (not shown) of the chuck 24, thereby aligning the central pin axis 48 with the drill chuck axis 26. Once the central pin axis 48 is aligned with the drill chuck axis 26, clamps "C" are used to secure the extended portions 60 of the base body 30 to the work table or platform "P" (FIG. 1A). In this way, the sander assembly 36 is positioned on the platform "P" in the predetermined location relative to the chuck 24. The user may utilize the primary and secondary sandpaper elements 54, 56 to form workpieces "W" into predetermined shapes.

The abrasive elements may be any suitable elements for abrasion of the workpiece that is to be shaped. Those skilled in the art would be aware of suitable abrasive elements for wood, ceramic, metal, or other materials.

Figure 7:
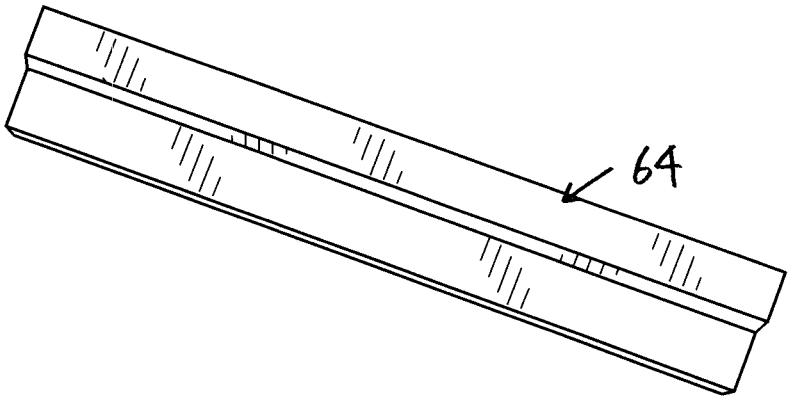
FIG. 7 is an isometric view of a raw element from which a guitar nut is to be formed, drawn at a larger scale.
Figure 8:
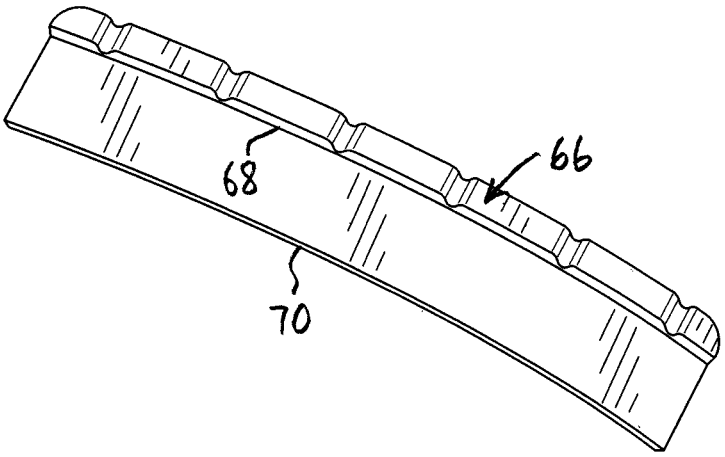
FIG. 8 is an isometric view of the guitar nut formed from the element of FIG. 7.

As an example, in FIG. 7, a raw workpiece 64 is illustrated. Those skilled in the art would appreciate that the raw workpiece 64 may be formed into a guitar nut 66 (FIG. 8). As can be seen in FIG. 8, the completed guitar nut 66 preferably defines convex curves 68, 70 that are formed to match precisely with a concave curve of a fingerboard (not shown) on a guitar's neck. Those skilled in the art would appreciate also that the product 66 is relatively small. Accordingly, this workpiece is an example of a workpiece that, due to its relatively small size and the precision required, the user may prefer to hold the workpiece against the abrasive element(s). From the foregoing, it can be seen that the convex curves of the guitar nut can be formed relatively easily by the user, using the primary sandpaper element 54 and the secondary sandpaper element 56 while the body element 38 on which the sandpaper elements are mounted rotates about the central pin axis 48.

Figure 9:
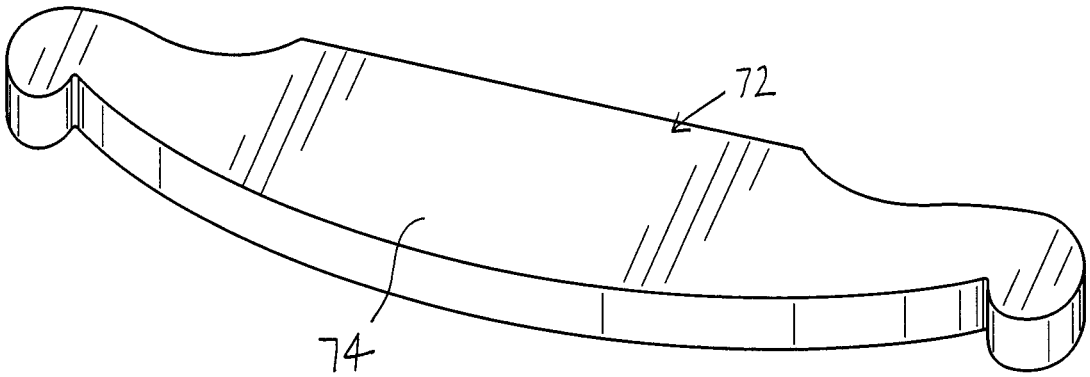
FIG. 9 is an isometric view of a bridge element of a guitar.

A completed bridge 72 is illustrated in FIG. 9. It will be understood that the bridge 72 includes a generally concave underside surface 74 that is formed precisely to engage with a body of a guitar (not shown). Those skilled in the art would appreciate that the surface 74 may be formed utilizing the apparatus 20 of the invention, when mounted to a drill press.

In another embodiment, the invention includes a system 110 that includes the drill press 22 and the sander apparatus 20.

In yet another embodiment, the invention includes a method of forming the workpiece into a predetermined shape, using the system 110 of the invention.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A sander apparatus for abrasion of a workpiece, the sander apparatus being configured for use with a drill press having a chuck defining a drill chuck axis, the sander apparatus comprising:

a base assembly comprising:

a base body;

a central bearing mounted in the base body, the central bearing defining an aperture therein;

at least one load bearing mounted on the base body;

a sander assembly comprising:

a body element defining a disc having a top surface, an opposed bottom surface, and an edge surface that is located transverse to the top and bottom surfaces;

a pin subassembly centrally positioned in the body element and secured to the body element, the pin subassembly being defined by a central pin axis, the pin subassembly comprising:

an upper shaft securable in the chuck to align the central pin axis with the chuck axis and extending from the top surface, and a lower shaft receivable in the aperture for engagement of the lower shaft with the central bearing to allow rotation of the lower shaft about the central pin axis;

a primary sandpaper element, secured to the top surface;

a secondary sandpaper element secured to the edge surface;

the base assembly being formed to locate the sander assembly in a predetermined location relative to the chuck such that the upper shaft is securable in the chuck wherein, when the upper shaft is secured in the chuck, rotation of the chuck about the drill chuck axis causes corresponding rotation of the body element about the central pin axis; and said at least one load bearing engaging the bottom surface, to support the sander assembly in the predetermined location against vertically-directed force to which the sander assembly is subjected when the workpiece is urged at least partially downwardly against the primary sandpaper element; and the central bearing being configured to engage the lower shaft, to support the sander assembly in the predetermined location against horizontally-directed force to which the sander assembly is subjected when the workpiece is urged at least partially transversely against the secondary sandpaper element relative to the central pin axis.

2. The sander apparatus according to claim 1 in which the top surface is curved to form a curved surface symmetrical with respect to the central pin axis, the curved surface being defined by a predetermined spherical radius.

3. The sander apparatus according to claim 2 in which the top surface is convex.

4. The sander apparatus according to claim 2 in which the predetermined spherical radius is at least 24 feet.

5. The sander apparatus according to claim 1 in which the sander assembly additionally comprises:

a layer with a lower side thereof secured to the top surface, the layer having an upper side that is adapted for removably securing the primary sandpaper element thereto; and an adhesive attached to the edge surface, to which the secondary sandpaper element is removably secured.

6. The sander apparatus according to claim 5 in which the top surface is concave.

7. A system comprising:

a drill press comprising a chuck defining a drill chuck axis and comprising a pillar supporting the chuck and a work table positioned below the chuck that is located transverse to the drill chuck axis;

a sander apparatus for abrasion of a workpiece, the sander apparatus comprising:

a base assembly comprising:

a base body comprising an aperture therein;

a central bearing mounted in the base body, the central bearing defining an aperture therein:

at least one load bearing mounted on the base body;

a sander assembly comprising:

a body element defining a disc having a top surface, an opposed bottom surface, and an edge surface that is located transverse to the top and bottom surfaces;

a pin subassembly centrally positioned in the body element and secured to the body element, the pin subassembly being defined by a central pin axis, the pin subassembly comprising:

an upper shaft securable in the chuck to align the central pin axis with the chuck axis and extending from the top surface, and a lower shaft receivable in the aperture for engagement of the lower shaft with the central bearing to allow rotation of the lower shaft about the central pin axis;

a primary sandpaper element, secured to the top surface;

a secondary sandpaper element, secured to the edge surface;

the base assembly being formed to locate the sander assembly in a predetermined location relative to the chuck such that the upper shaft is securable in the chuck wherein, when the upper shaft is secured in the chuck, rotation of the chuck about the drill chuck axis causes corresponding rotation of the body element about the central pin axis;

said at least one load bearing engaging the bottom surface to support the sander assembly in the predetermined location against vertically-directed force to which the sander assembly is subjected when the workpiece is urged at least partially downwardly on the primary sandpaper element; and the central bearing the lower shaft, to support the sander assembly in the predetermined location against horizontally-directed force to which the sander assembly is subjected when the workpiece is urged at least partially transversely against the secondary sandpaper element relative to the central pin axis.

8. The system according to claim 7 in which:

the base body comprises at least one extended portion that extends radially outwardly from the central pin axis, for securing the base body to the drill press; and the base body comprises an opening therein defined by an edge portion of the base body in which the pillar is partially receivable for positioning the base assembly in relation to the chuck axis such that when the sander assembly is mounted on the base assembly, the sander assembly is positioned in the predetermined location relative to the chuck.

9. The system according to claim 7 in which the top surface is curved to form a curved surface symmetrical with respect to the central pin axis, the curved surface being defined by a predetermined spherical radius.

10. The system according to claim 9 in which the top surface is convex.

11. The system according to claim 9 in which the predetermined spherical radius is at least 24 feet.

12. The system according to claim 7 in which the sander assembly additionally comprises:

a layer with a lower side thereof secured to the top surface, the layer having an upper side that is adapted for removably securing the primary sandpaper element thereto; and an adhesive attached to the edge surface, to which the secondary sandpaper element is removably secured.

13. A method of forming a workpiece into a predetermined shape, the method comprising the steps of:

(a) providing a drill press comprising a chuck defining a drill chuck axis and comprising a pillar supporting the chuck and a work table positioned below the chuck and transverse to the drill chuck axis;

(b) providing a sander apparatus for abrasion of the workpiece, the sander apparatus comprising:

a base assembly comprising:

a base body comprising an aperture therein;

a central bearing mounted in the base body, the central bearing defining an aperture therein;

at least one load bearing mounted on the base body;

a sander assembly comprising:

a body element defining a disc having a top surface, an opposed bottom surface, and an edge surface that is located transverse to the top and bottom surfaces;

a pin subassembly centrally positioned in the body element and secured to the body element, the pin subassembly being defined by a central pin axis, the pin subassembly comprising:

an upper shaft securable in the chuck to align the central pin axis with the chuck axis and extending from the top surface, and a lower shaft receivable in the aperture for engagement of the lower shaft with the central bearing to allow rotation of the lower shaft about the central pin axis;

a primary sandpaper element, secured to the top surface;

a secondary sandpaper element, secured to the edge surface, wherein the base assembly is formed to locate the sander assembly in a predetermined location relative to the chuck such that the upper shaft is securable in the chuck and rotation of the chuck about the drill chuck axis causes corresponding rotation of the body element about the central pin axis;

(c) engaging the workpiece with one or both of the primary sandpaper element and the secondary sandpaper element while the body element rotates about the central pin axis, to form the workpiece into the predetermined shape, wherein said at least one load bearing engages the bottom surface to support the sander assembly in the predetermined location against vertically-directed force to which the sander assembly is subiected when the workpiece is urged at least partially downwardly on the primary sandpaper element, and wherein the central bearing engages the lower shaft to support the sander assembly in the predetermined location against horizontally-directed force to which the sander assembly is subiected when the workpiece is urged at least partially transversely against the secondary sandpaper element relative to the central pin axis.

* * * * *